US011753888B2

(12) United States Patent
Lohi et al.

(10) Patent No.: US 11,753,888 B2
(45) Date of Patent: Sep. 12, 2023

(54) BIASED CONTROL UNIT

(71) Applicant: Schlumberger Technology Corporation, Sugar Land, TX (US)

(72) Inventors: Nikolas Lohi, Stonehouse (GB); Paul Michael Linford, Stonehouse (GB); Abdiwahid Alasow, Stonehouse (GB); Juho Pekka Piiparinen, Stonehouse (GB); Alexander Hickson, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 112 days.

(21) Appl. No.: 17/595,389

(22) PCT Filed: May 7, 2020

(86) PCT No.: PCT/US2020/031755

§ 371 (c)(1),
(2) Date: Nov. 16, 2021

(87) PCT Pub. No.: WO2020/236430

PCT Pub. Date: Nov. 26, 2020

(65) Prior Publication Data

US 2022/0205330 A1 Jun. 30, 2022

Related U.S. Application Data

(60) Provisional application No. 62/850,680, filed on May 21, 2019.

(51) Int. Cl.
*E21B 23/04* (2006.01)

(52) U.S. Cl.
CPC ..... *E21B 23/0416* (2020.05)

(58) Field of Classification Search
CPC ..... E21B 23/04
See application file for complete search history.

(56) References Cited

U.S. PATENT DOCUMENTS 5,551,510 A * 9/1996 Mills ..... F04C 15/0057 188/82.1
6,039,115 A * 3/2000 Mills ..... E21B 43/126 188/82.1

(Continued)

FOREIGN PATENT DOCUMENTS

WO 2009129386 A2 10/2009
WO 2017019073 A1 2/2017

OTHER PUBLICATIONS

International Search Report and Written Opinion in International Patent Application No. PCT/US2020/031755, dated Aug. 20, 2020, 11 pages.

*Primary Examiner* — Shane Bomar

(57) ABSTRACT

A control unit includes a rotatable tubular body that rotates around a spindle. A torque transfer unit may be attached to the tubular body and the spindle. A force applied to the torque transfer unit by a biasing element may control a first torque applied by the tubular body to the spindle. The first torque is independent of a rotational velocity of the tubular body. A second torque is applied to the spindle with a torque generator, the second torque controlling the net torque. Controlling the net torque allows the absolute orientation of the control unit to be controlled.

13 Claims, 10 Drawing Sheets

(56) References Cited

U.S. PATENT DOCUMENTS

| | | | | |
|---|---|---|---|---|
| 6,092,595 | A * | 7/2000 | Fecht | E21B 43/126 166/105 |
| 2002/0195278 | A1 | 12/2002 | Vandenberg et al. | |
| 2006/0157246 | A1 * | 7/2006 | Zeer | E21B 10/26 166/55 |
| 2006/0254825 | A1 | 11/2006 | Krueger et al. | |
| 2010/0107811 | A1 * | 5/2010 | McCloy | F16D 28/00 74/665 F |
| 2014/0209389 | A1 | 7/2014 | Sugiura et al. | |
| 2015/0315902 | A1 * | 11/2015 | Beach | E21B 47/024 175/45 |
| 2020/0023501 | A1 * | 1/2020 | Bandy | B25B 23/1453 |

* cited by examiner

BIASED CONTROL UNIT

CROSS-REFERENCE TO RELATED APPLICATIONS

This application claims the benefit of U.S. Provisional Application No. 62/850,680 entitled "Biased Control Unit" filed May 21, 2019, the disclosure of which is incorporated herein by reference.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

The wellbores may be drilled by a drilling system that drills through earthen material downward from the surface. Some wellbores are drilled vertically downward, and some wellbores have one or more curves in the wellbore to follow desirable geological formations, avoid problematic geological formations, or a combination of the two.

SUMMARY

In some embodiments, a control unit may include a spindle, a tubular body rotatable relative to the spindle, and a torque transfer unit attached to the spindle and the tubular body. A biasing element may maintain a force against the torque transfer unit such that a first torque may be applied to the spindle that is independent of a rotational velocity of the tubular body. A second torque may be applied to the spindle with a torque generator to control a net torque on the spindle.

In other embodiments, a method for biasing a control unit may include rotating a tubular body connected to a torque transfer unit with a rotational velocity. The torque transfer unit may apply a first torque to a spindle, the first torque being dependent upon a force applied to the torque transfer unit with a biasing element. A second torque may be applied to the spindle with a torque generator, the second torque being used to control a net torque.

In yet other embodiments, a method for biasing a control unit may include flowing a first flow of drilling fluid across a control unit, causing a tubular body to rotate with a first rotational velocity and transfer a first torque to a spindle through a torque transfer unit. A second torque may be applied to the spindle using a torque generator. A second flow may be flowed across the control unit, the second flow having a different fluid property from the first flow, causing the tubular body to rotate with a second rotational velocity. The torque transferred to the spindle may remain the same for both the first and second rotational velocity.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
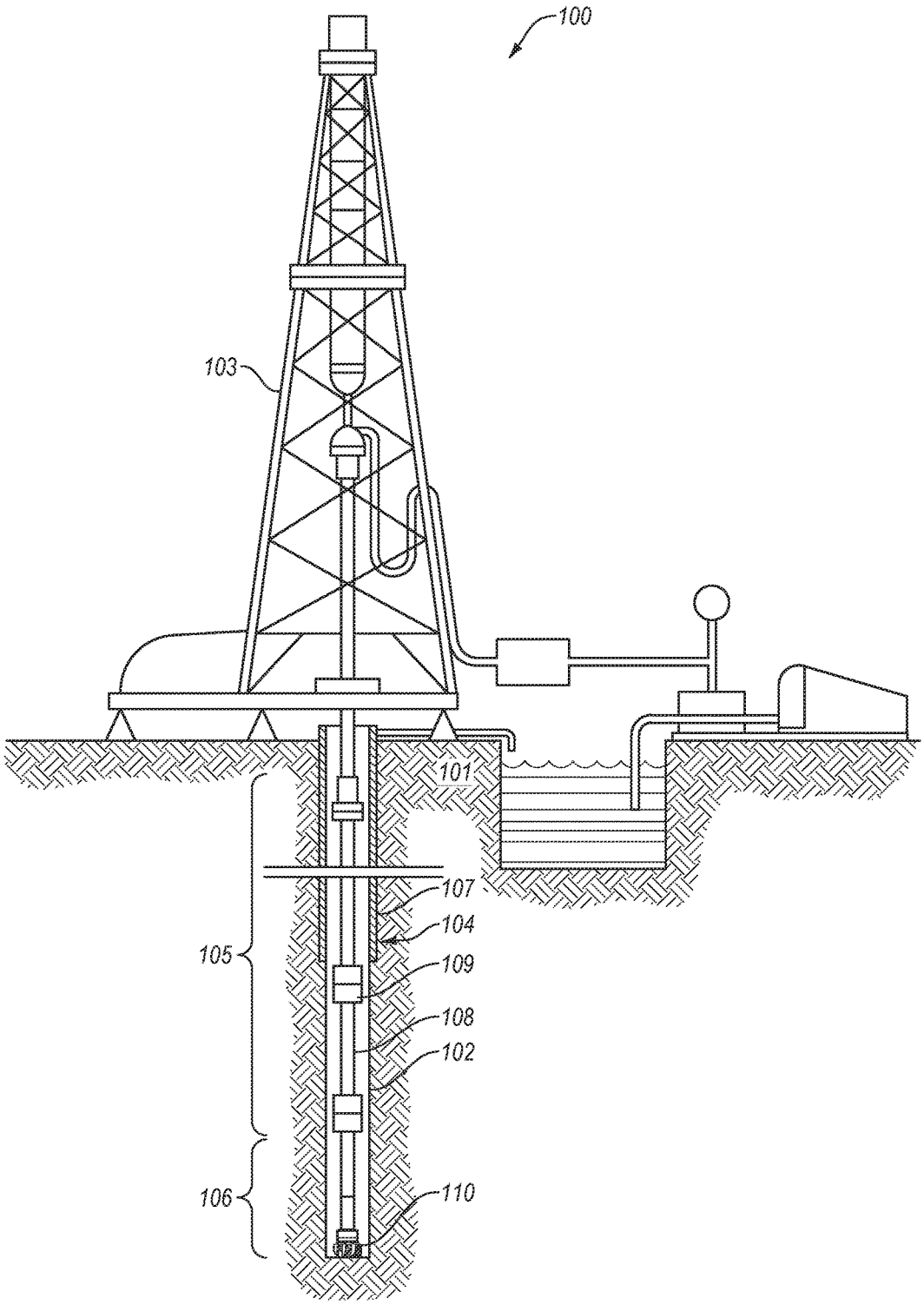
FIG. 1 is a schematic view of a general drilling station, according to at least one embodiment of the present disclosure.

This disclosure generally relates to devices, systems, and methods for biasing a control unit. FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 a connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole.

Figure 2:
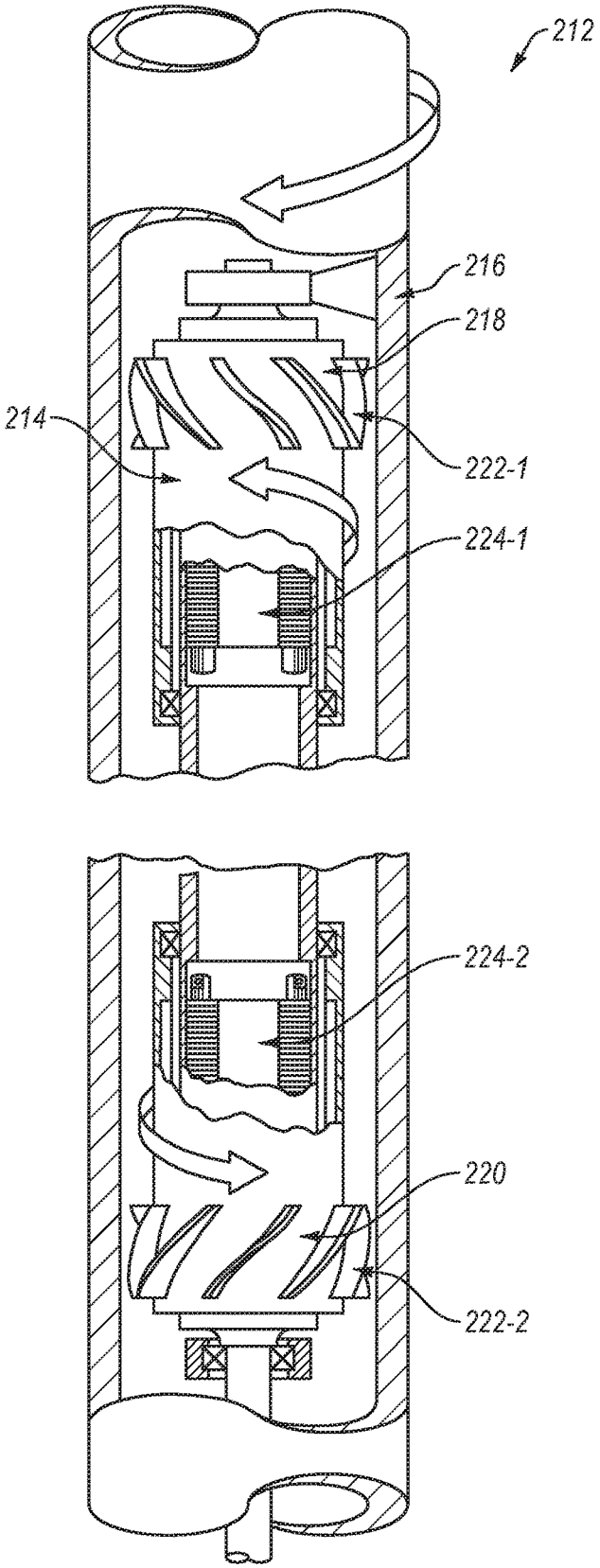
FIG. 2 Prior Art
FIG. 2 is representation of a prior art bias control unit.

FIG. 2 represents an embodiment of a conventional rotary steerable unit 212 that may be included in a BHA (such as BHA 106 of FIG. 1). A control unit 214 may be located inside the instrument carrier 216. The control unit 214 may include an upper impeller 218 and a lower impeller 220. Upper impeller 218 includes a plurality of upper impeller fins 222-1, and lower impeller 220 includes a plurality of lower impeller fins 222-2. Upper impeller fins 222-1 and lower impeller fins 222-2 may be oriented such that upper impeller 218 rotates in a different direction from lower impeller 220.

Upper impeller 218 is coupled to an upper electrical torque generator 224-1, which transmits torque from rotation of the upper impeller 218 to the control unit 214. Lower impeller 220 is also coupled to a lower electrical torque generator 224-2, which transmits torque from rotation of the lower impeller 220 to the control unit 214. Because the upper impeller 218 and the lower impeller 220 rotate in different directions, opposite torques may be applied to the control unit 214. The amount of electrical load on the torque generators 224-1, 224-2 may be changed to vary the torque applied on the control unit 214 by the upper impeller 218 and lower impeller 220. Thus, the orientation of the control unit 214 may be controlled by varying the electrical load applied to one or both of the torque generators 224-1, 224-2. To steer in a given direction, the control unit 214 may be held substantially geostationary. The control unit 214 can then control a valve which allows flow (e.g., mud flow) to pads of a unit (e.g., a bias unit) that steers by pushing against the formation as the bias unit rotates with respect to the geostationary control unit 214 and valve. The steering direction may then be changed by changing the orientation of the control unit 214. Any suitable type of bias unit may be used.

In some situations, the bearings and other spaces of one or both of the upper impeller 218 and the lower impeller 220 may fill with debris, increasing wear and the chance for an impeller to jam (e.g., seize and stop rotating). Therefore, it may be desirable for the control unit to only include one (e.g., a single) rotating component as described herein. This may, in certain situations, improve downhole reliability, which may increase drilling rates and decrease overall drilling costs. In some embodiments, one of the upper or lower impellers can be replaced with other features, as will be described herein, which reduce or mitigate the jamming issues that are sometimes observed with the use of impellers. In some embodiments, an upper impeller may generate electricity for the control unit as well as impart torque in a first direction, and the lower torquer may be replaced by a torque transfer unit that uses friction to impart friction in a second direction opposite the first direction.

Figure 3:
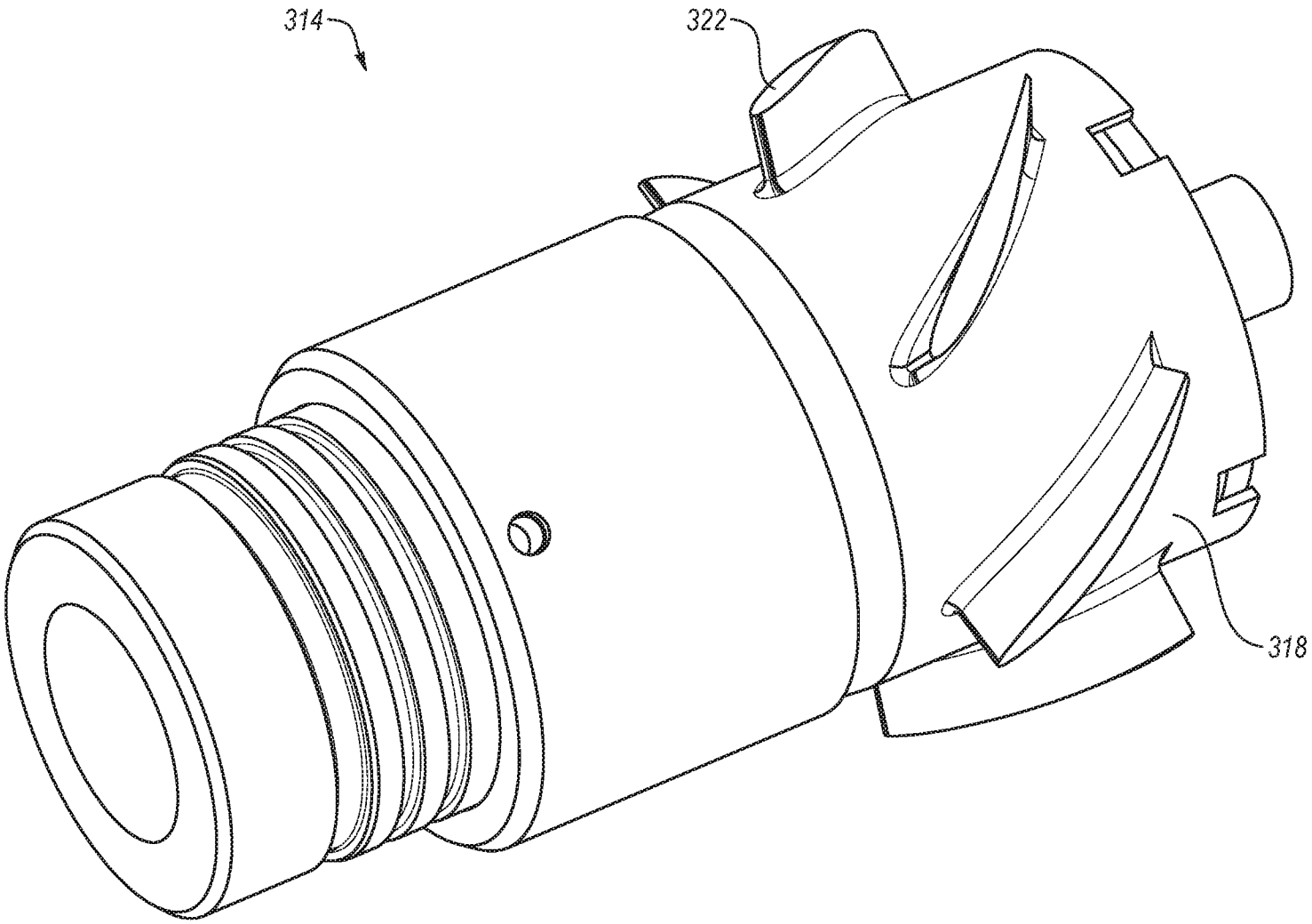
FIG. 3 is a perspective view of a control unit, according to at least one embodiment of the present disclosure.

FIG. 3 is a perspective view of a control unit 314, according to at least one embodiment of the present disclosure. In some embodiments, the control unit 314 may be configured to be positioned inside of a drill pipe (e.g., drill pipe 108 of FIG. 1) and/or in a BHA (e.g., BHA 106 of FIG. 1) or other tubular member. The control unit 314 includes a tubular body 318. In some embodiments, the tubular body 318 may be or include an impeller. For example, the tubular body 318 may have a plurality of fins 322. The plurality of fins 322 may be oriented such that, as drilling fluid is passed across the control unit 314, the drilling fluid will impact the plurality of fins 322, causing at least a portion of the tubular body 318 to rotate.

Figure 4:
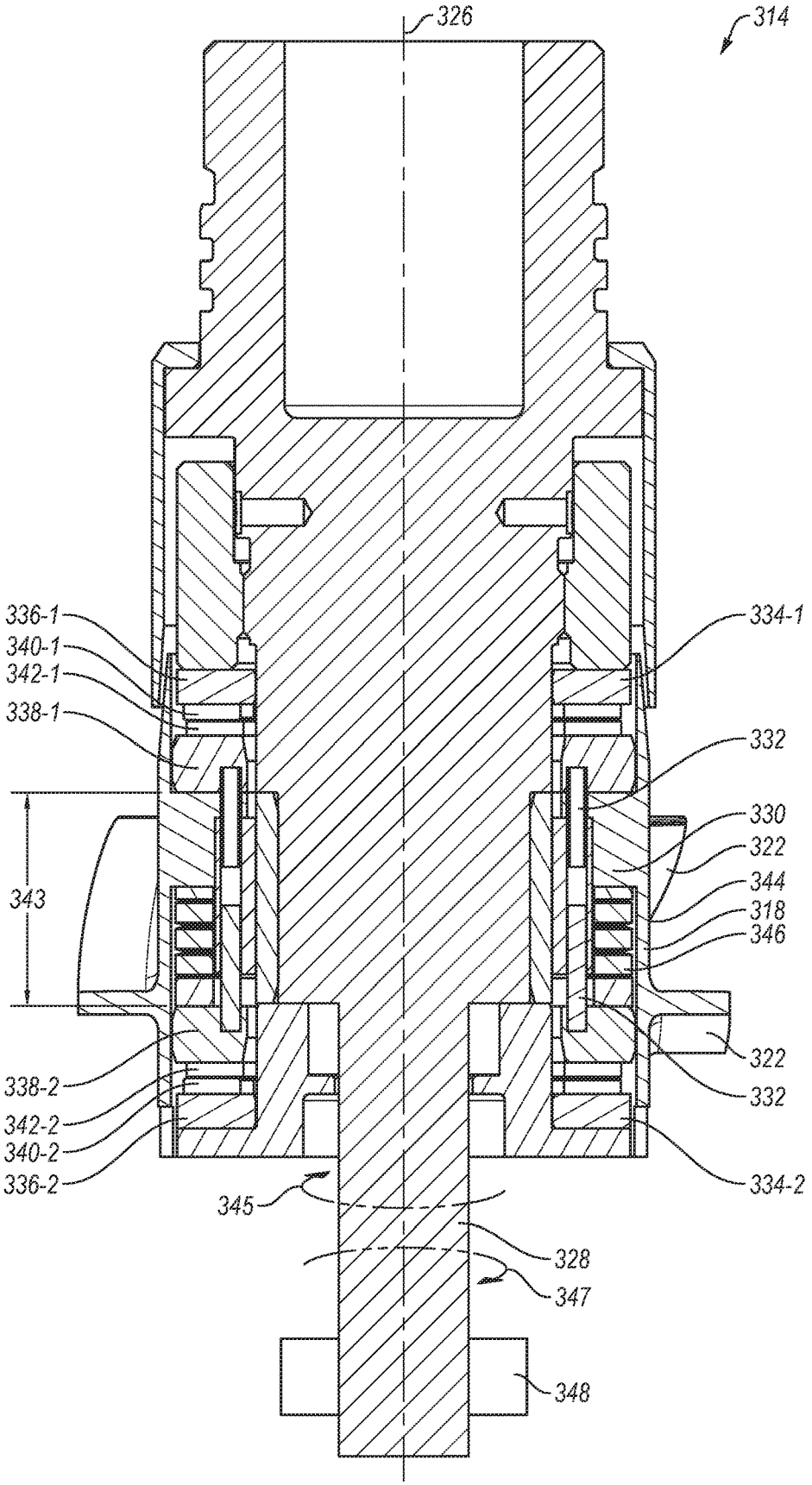
FIG. 4 is a longitudinal cross-sectional view of the control unit of FIG. 3, according to at least one embodiment of the present disclosure.

FIG. 4 represents the control unit 314 of FIG. 3. The tubular body 318 may be configured to rotate about the control unit axis 326. The control unit 314 also includes a spindle 328, also configured to rotate around the control unit axis 326. In some embodiments, the tubular body 318 is the only tubular body 318 that rotates about the spindle. In other words, the control unit 314 may include a single (e.g., not more than one) tubular body 318. The tubular body 318 may include a bearing member 330. The bearing member 330 may include one or more lips 332. The lips 332 may be oriented radially inward from the tubular body 318 or coaxial with the tubular body.

In some embodiments, the control unit 314 may be rotationally independent from other portions of the BHA (e.g., BHA 106 of FIG. 1). In other words, the control unit 314 may be configured to rotate at a different rotational velocity than the surrounding BHA. In some embodiments, the control unit 314 may be rotationally independent from, or configured to rotate at a different rotationally velocity than, the drill bit (e.g., bit 110 of FIG. 1).

In some embodiments, one or more torque transfer units 334-1, 334-2 may be attached to the spindle 328 and the tubular body 318. The torque transfer units 334-1, 334-2 may extend around a circumference of the spindle 328, and include a first member 336-1, 336-2 attached to the spindle 328 and a second member 338-1, 338-2 attached to the tubular body 318. In some embodiments, the second member 338-1, 338-2 may be attached to the tubular body 318 at the lips 332. The first member 336-1, 336-2 has a first bearing surface 340-1, 340-2, and the second member 338-1, 338-2 has a second bearing surface 342-1, 342-2. The first bearing surface 340-1, 340-2 abuts against or contacts the second bearing surface 342-1, 342-2. In the illustrated embodiment, the first bearing surface 340-1, 340-2 and/or the second bearing surface 342-1, 342-2 may be oriented perpendicular to the spindle 328. For example, the first bearing surface 340-1, 340-2 and/or the second bearing surface 342-1, 342-2 may be oriented perpendicular to the control unit axis 326 of the control unit 314. A static coefficient of friction exists between the first bearing surface 340-1, 340-2 and the second bearing surface 342-1, 342-2 when the torque transfer units 334-1, 334-2 are stationary relative to one another. A kinetic coefficient of friction exists between the first bearing surface 340-1, 340-2 and the second bearing surface 342-1, 342-2 while the torque transfer units 334-1, 334-2 move or rotate relative to each other.

In some embodiments, the control unit 314 may include two torque transfer units: an upper torque transfer unit 334-1 and a lower torque transfer unit 334-2. In some embodiments, the torque transfer units 334-1, 334-2 may be located adjacent to each other, or near each other. The upper second member 338-1 is separated from the lower second member 338-2 by a separation distance 343. In some embodiments, the separation distance 343 may be in a range having an upper value, a lower value, or upper and lower values including any of 0.1 cm, 0.2 cm, 0.4 cm, 0.6 cm, 0.8 cm, 1.0 cm, 2.0 cm, 3.0 cm, 4.0 cm, 5.0 cm, 6.0 cm, 7.0 cm, 8.0 cm, 9.0 cm, 10.0 cm, or any value therebetween. For example, the separation distance 343 may be greater than 0.1 cm. In another example, the separation distance 343 may be less than 10.0 cm. In yet other examples, the separation distance 343 may be any value in a range between 0.1 cm and 10.0 cm. In some embodiments, the separation distance 343 may be equal to the thickness of the lip 332. In other embodiments, the separation distance 343 may be greater than the thickness of the lip 332. In some embodiments, it may be critical that the separation distance be between 6.0 cm and 10.0 cm. The separation distance 343 may be sufficient for the placement of a hub aero foil section in the space between the upper second member 338-1 and the lower second member 338-2.

In some embodiments, the tubular body 318 may include more than one lip 332, attached to more than one pair of torque transfer units 334-1, 334-2. For example, the tubular body 318 may include two lips, attached to four torque transfer units. In another example, the tubular body 318 may include three lips, attached to six torque transfer units.

In other embodiments, the control unit 314 may include one torque transfer unit. In still other embodiments, the control unit 314 may include 3, 4, 5, or 6 torque transfer units.

As the tubular body 318 rotates, the second bearing surface 342-1, 342-2 may slide along the first bearing surface 340-1, 340-2. Thus, in some embodiments, the torque transfer units 334-1, 334-2 may be axial bearings. In some embodiments, the first bearing surface 340-1, 340-2 and the second bearing surface 342-1, 342-2 may be fabricated from tungsten carbide (WC). In other embodiments, the first bearing surface 340-1, 340-2 and the second bearing surface 342-1, 342-2 may be fabricated from polycrystalline diamond (PCD). In still other embodiments, the first bearing surface 340-1, 340-2 and the second bearing surface 342-1, 342-2 may be fabricated from any wear-resistant material, such as silicon carbide or cubic boron nitride.

In some embodiments, the first bearing surface 340-1, 340-2 and the second bearing surface 342-1, 342-2 may be fabricated from the same material. For example, the first bearing surface 340-1, 340-2 and the second bearing surface 342-1, 342-2 may both be fabricated from PCD. In other examples, the first bearing surface 340-1, 340-2 and the second bearing surface 342-1, 342-2 may be fabricated from WC.

In other embodiments, the first bearing surface 340-1, 340-2 and the second bearing surface 342-1, 342-2 may be fabricated from different materials. For example, the first bearing surface 340-1, 340-2 may be fabricated from PCD and the second bearing surface 342-1, 342-2 may be fabricated from WC. In other examples, the first bearing surface 340-1, 340-2 may be fabricated from WC, and the second bearing surface 342-1, 342-2 may be fabricated from PCD. In still other embodiments, the one or more torque transfer units 334-1, 334-2 may include opposing discs each having a ring of PCD buttons mounted on matching faces. Each ring of PCD buttons may be aligned in an equally spaced circular pattern, with each ring having a different number of equally spaced PCD buttons such that all PCD buttons will never completely overlay each other. The bearing surface (e.g., the first bearing surface 340-1, 340-2 and the second bearing surface 342-1, 342-2) of each ring may be ground such that the PCD surface of each button is at the same height when measured from the face of the disc. However, any suitable bearing may be used.

In some embodiments, the one or more torque transfer units 334-1, 334-2 may be thrust bearings, including a polycrystalline diamond surface. The combination of materials on the first bearing surface 340-1, 340-2 and the second bearing surface 342-1, 342-1 may contribute to the static coefficient of friction and the kinetic coefficient of friction.

A biasing element 344 may be connected to the spindle 328. In some embodiments, the biasing element 344 may include a resilient member 346 biased against the lower torque transfer unit 334-2. Or, in other words, the biasing element 344 may apply a force to the lower first member 336-2. In still other words, the biasing element 344 may maintain the position of the first member 336-1, 336-2 against the second member 338-1, 338-2. A force applied to the lower first member 336-2 may be transferred to the lower second member 338-2. The lower second member 338-2 may transfer the force to the lip 332 of the tubular body 318, which may transfer the force to the upper second member 338-1. The force may then transfer from the upper second member 338-1 to the upper first member 336-1.

In embodiments including more than two torque transfer units 334-1, 334-2 (e.g., more than one lip 332 on the tubular body 318), each torque transfer unit 334-1, 334-2 may include its own biasing element 344. In other embodiments, each torque transfer unit pair (such as upper torque transfer unit 334-1 and lower torque transfer unit 334-2) may include a biasing element 344. In still other embodiments, a biasing element 344 may apply force through more than two torque transfer units 334-1, 334-2.

In some embodiments, the upper first member 336-1 may be both longitudinally and rotationally rigidly attached to the spindle 328. Thus, the force applied by the biasing element 344 may be applied to the upper first member 336-1. This force may sandwich the torque transfer units 334-1, 334-2 between the biasing element 344 and the upper first member 336-1. A greater force applied to the torque transfer units 334-1, 334-2 will result in a greater static friction force and a greater kinetic friction force. Thus, the static friction force and the kinetic friction force are dependent upon the force applied to the torque transfer units 334-1, 334-2 and the static coefficient of friction and the kinetic coefficient of friction.

In some embodiments, the resilient member 346 may be a conical or frustoconical washer, such as a Belleville spring. In other embodiments, the resilient member 346 may be a coil spring, a leaf spring, or any other type of member configured to apply a force against the lower first member 336-2. In still other embodiments, the resilient member 346 may be a piston, such as a hydraulic or pneumatic piston. A hydraulic or pneumatic piston may enable the force applied by the biasing element 344 to be changed during operation.

In some embodiments, the location of the biasing element 344 may be varied along the length of the spindle 328. Varying the location of the biasing element 344 may change the force applied by the resilient member 346 against the lower first member 336-2. Or, in other words, varying the position of the biasing element 344 on the spindle 328 may vary the force applied to the torque transfer units 334-1, 334-2. For example, moving the biasing element 344 closer to the lower first member 336-2 may increase the force applied against the lower first member 336-2, thereby increasing the static friction force and the kinetic friction force. In other examples, moving the biasing element 344 further from the lower first member 336-2 may decrease the force applied against the lower first member 336-2, thereby decreasing the static friction force and the kinetic friction force.

In some embodiments, the biasing element 344 may be installed on the spindle 328 using a threaded connection. By rotating the biasing element 344 on the threaded connection, the longitudinal position of the biasing element 344 may be changed, and therefore the force applied to torque transfer units 334-1, 334-2 may be changed. In this manner, the static coefficient of friction and the kinetic coefficient of friction may be changed by moving the biasing element 344 on the threaded connection.

In some embodiments, the lower first member 336-2 may be longitudinally slidably attached to the spindle 328. Or, in other words, the lower first member 336-2 may slide along the spindle 328 parallel to the control unit axis 326 but remain rotationally fixed to the spindle 328. This may be accomplished, for example, by one or more dove-tail type connections between the inner surface of the lower first member 336-2 and the outer surface of the spindle 328. Having a longitudinally slidable connection at the lower first member 336-2 may allow the force from the biasing element 344 to transfer more fully to the remaining members of the torque transfer units 334-1, 334-2. In some embodiments, the tubular body 318 may be longitudinally secured or held in place by the force applied by the biasing element 344.

In other embodiments, the biasing element 344 may be installed on the spindle 328 between the torque transfer units 334-1, 334-2. The upper second member 338-1 and the lower second member 338-2 may be slidably attached to the spindle 328. Or, in other words, the upper second member 338-1 and the lower second member 338-2 may slide along the spindle 328 parallel to the control unit axis 326 but remain rotationally fixed to the spindle 328. This may be accomplished, for example, by one or more dove-tail type connections between the inner surfaces of the upper second member 338-1 and the lower second member 338-2 and the outer surface of the spindle 328. Having a longitudinally slidable connection at the upper second member 338-1 and the lower second member 338-2 may allow the force from the biasing element 344 to transfer more fully to the remaining members of the torque transfer units 334-1, 334-2 (e.g., the upper first member 336-1 and the lower first member 336-2). In some embodiments, the tubular body 318 may be longitudinally secured or held in place by the force applied by the biasing element 344.

Drilling fluid impacting the plurality of fins 322 on the tubular body 318 may apply a torque to the tubular body 318. The tubular body 318 may transfer the torque to the first member 336-1, 336-2. The torque will urge the first bearing surface 340-1, 340-2 to slide against the second bearing surface 342-1, 342-2, or, in other words, the torque will urge the first member 336-1, 336-2 to rotate relative to the second member 338-1, 338-2. When the torque reaches a breakout torque, the first bearing surface 340-1, 340-2 will begin to slide against the second bearing surface 342-1, 342-2, or, in other words, the first member 336-1, 336-2 will begin to rotate relative to the second member 338-1, 338-2. The breakout torque is the torque at which the static friction force is overcome and is dependent upon the static coefficient of friction and the static friction force. In other words, a higher static coefficient of friction and/or static friction force will result in a higher breakout torque. In still other words, a higher force applied by the biasing element 344 will result in a higher breakout torque.

Different properties of the drilling fluid may affect the torque applied to the tubular body 318, and therefore the rotational velocity of the tubular body 318. For example, a higher volumetric flow rate may increase the rotational velocity, and a lower volumetric flow rate may decrease the rotational velocity. A higher mud density may increase the force applied against the plurality of fins 322, thereby increasing the rotational velocity, and a lower mud density may decrease the rotational velocity. Other fluid properties include mud viscosity, mud composition (e.g., water-based, oil-based, chemical additives, or elemental additives), mud pressure, or other fluid property.

As the first member 336-1, 336-2 rotates relative to the second member 338-1, 338-2, the second member 338-1, 338-2 will transfer a first torque 345 to the first member 336-1, 336-2, which will transfer the torque to the spindle 328. Thus, the tubular body 318 transfers torque to the spindle 328 through the torque transfer units 334-1, 334-2. The first torque 345 transfers through the torque transfer units 334-1, 334-2 as a result of the kinetic friction force. A higher kinetic friction force will transfer more torque from the tubular body 318 to the spindle 328, and a lower kinetic friction force will transfer less torque from the tubular body 318 to the spindle 328.

In some embodiments, the first torque 345 may be in a range having an upper value, a lower value, or upper and lower values including any of 0.0 N·m, 0.5 N·m, 1.0 N·m, 1.5 N·m, 2.0 N·m, 2.5 N·m, 3.0 N·m, 3.5 N·m, 4.0 N·m, 4.5 N·m, 5.0 N·m, 6 N m, 7 N m, 8 N m, 9 N m, 10 N m, or any value therebetween. In an example, the first torque 345 may be less than 5.0 N·m. In another example, the first torque 345 may be less than 10 Nm.

The first torque 345 may cause the spindle 328 to rotate with a spindle rotational velocity. The spindle rotational velocity may be different than a rotational velocity of the surrounding BHA (e.g., BHA 106 of FIG. 1). The control unit 314 may include a torque generator 348. The torque generator 348 may be configured to apply a second torque 347 against the spindle 328. The second torque 347 may be opposite in direction from the first torque 345, or, in other words, the second torque 347 may be a counter-torque to the first torque 345. For example, if the first torque 345 is counter-clockwise, then the second torque 347 would be clockwise. Similarly, if the first torque 345 is clockwise, then the second torque 347 would be counter-clockwise.

The torque generator 348 may include any device configured to apply a torque to the spindle 328. In some embodiments, the torque generator 348 may be an electromagnetic brake. For example, the spindle 328 may include a plurality of magnets placed circumferentially around the outside of the spindle 328. A corresponding set of electromagnets may be located radially offset from the spindle 328. In other examples, the spindle 328 may include a plurality of electromagnetics and permanent magnets may be located radially offset from the spindle 328. As an electrical load is applied to the electromagnets, the electromagnets and the magnets will interact, thereby creating a second torque 347, or counter-torque, on the spindle 328.

In other embodiments, the torque generator 348 may be a mechanical brake. For example, the torque generator 348 may be a band brake. In other examples, the torque generator 348 may be a disc brake. The spindle 328 may include a circumferential disc against which calipers may be applied, thereby applying a second torque 347.

In some embodiments, the second torque 347 may be in a range having an upper value, a lower value, or upper and lower values including any of 0.5 N m, 1.0 N·m, 2.0 N·m, 3.0 N·m, 4.0 N·m, 5.0 N·m, 6.0 N·m, 7.0 N·m, 8.0 N·m, 8.0 N·m, 10.0 N·m, 12.0 N·m, 14 N·m, 16 N m, 18 N m, 20 N m, 25 N m, 30 N m, 35 N m, 40 N m, 45 N m, 50 N m or any value therebetween. For example, the second torque 347 may be greater than 0.5 N m. In another example, the second torque 347 may be less than 50 N·m. In yet other examples, the second torque 347 may be any value in a range between 0.5 N·m and 50 N·m. In further examples, the second torque 347 may be in a range between 1.0 N m and 14 N m.

The first torque 345 and the second torque 347 may be related to one another. For example, the first torque 345 may transfer rotation from the tubular body 318 to the spindle 328 to rotate the spindle 328 in a first direction, while the second torque 347 may be oriented in an opposite rotational direction to counteract the rotation in the first direction. The relative magnitude of the first torque 345 and the second torque 347 may, therefore, affect the absolute rotation of the spindle 328 relative to the surrounding environment of the control unit 314.

In some embodiments, the first torque 345 and the second torque 347 may have a first magnitude and a second magnitude, respectively, that are the same, and the first torque 345 and the second torque 347 may counteract one another. In other embodiments, the second magnitude may be within 10% of the first magnitude. For example, the spindle 328 may be asymmetrically balanced relative to the control unit axis 326. In such examples, the spindle 328 may "settle" in a particular orientation relative to gravity when the control unit 314 is located in a lateral borehole. The force of gravity may be sufficient to retain the spindle 328 in the particular orientation when the second magnitude counteracts at least 80% of the first magnitude. In yet other embodiments, the second magnitude may be within 5% of the first magnitude (i.e., counteracting at least 85% of the first magnitude). In further embodiments, the second magnitude may be within 1% of the first magnitude (i.e., counteracting at least 89% of the first magnitude).

In some embodiments, the first torque 345 may remain constant above a minimum rotational velocity of the tubular body 318. Or, in other words, the kinetic friction force may be independent of the rotational velocity of the tubular body 318. Or, in still other words, the first torque 345 is independent of the rotational velocity of the tubular body 318 above the minimum rotational velocity.

In some embodiments, the first torque 345 may fluctuate in a range having an upper value, a lower value, or upper and lower values including any of 1%, 2%, 3%, 4%, 5%, 6%, 7%, 8%, 8%, 10%, or any value therebetween. For example, the first torque 345 may fluctuate more than 1%. In another example, the first torque 345 fluctuate less than 10%. In yet other examples, the first torque 345 fluctuate any value in a range between 1% and 10%.

In some embodiments, the minimum rotational velocity may be in a range having an upper value, a lower value, or upper and lower values including any of 0 rotations per minute (RPM), 100 RPM, 500 RPM, 1,000 RPM, 1,500 RPM, 2,000 RPM, 2,500 RPM, 3,000 RPM, 3,500 RPM, 4,000 RPM, 4,500 RPM, 5,000 RPM, or any value therebetween. For example, the minimum rotational velocity may be any value in a range between 0 RPM and 5,000 RPM.

Figure 5:
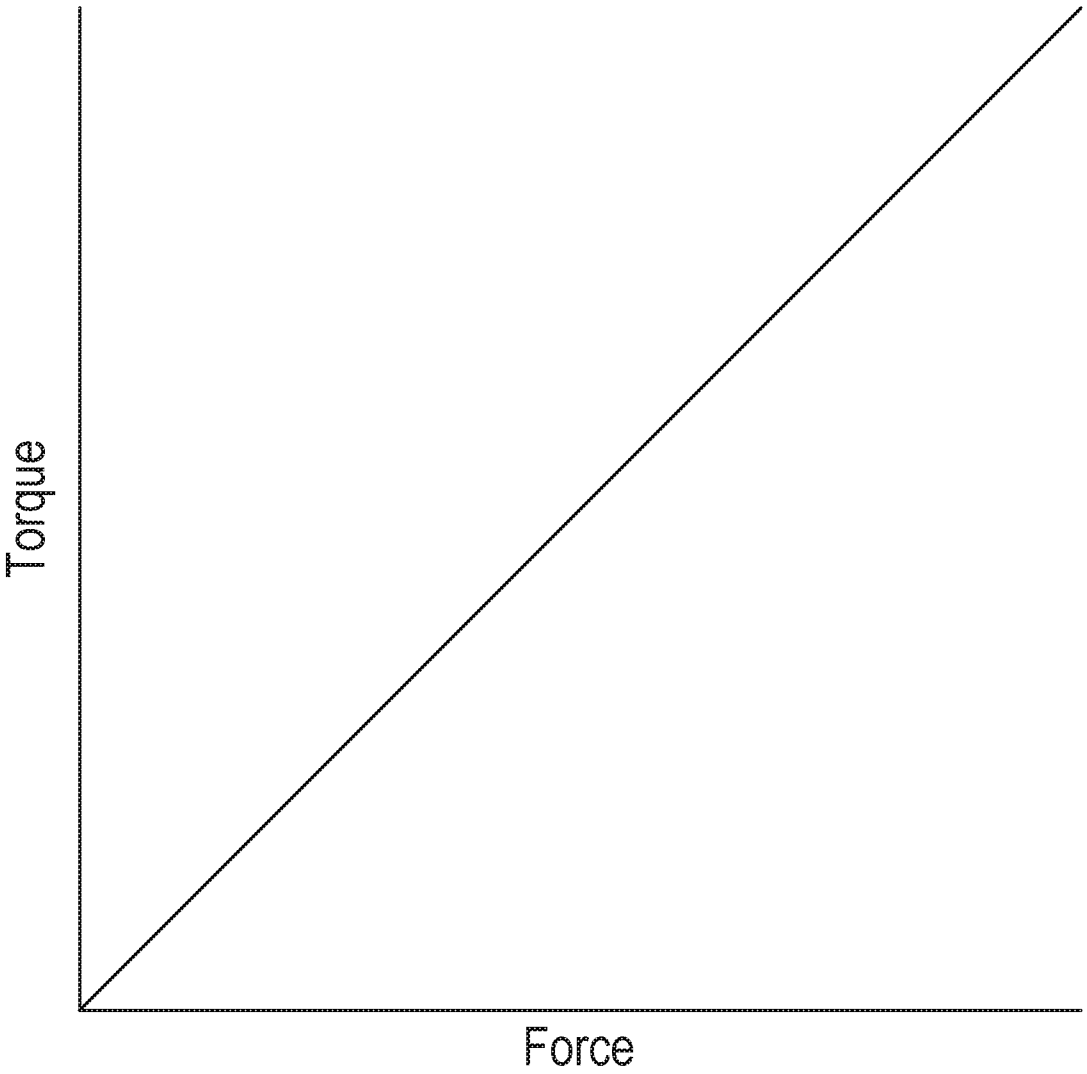
FIG. 5 is a plot of the relationship between force and torque, according to at least one embodiment of the present disclosure.

Specific torque transfer units 334-1, 334-2 having first bearing surfaces 340-1, 340-2 second bearing surfaces 342-1, 342-2 made of known materials may indicate, for a given force, what the magnitude of the first torque 345 may be. FIG. 5 is a graph that represents the relationship between force applied to a torque transfer unit (such as the force applied by biasing element 344 against torque transfer units 334-1, 334-2 of FIG. 4) and torque (such as the first torque 345 of FIG. 4). This graph indicates that the torque is dependent upon the force applied against a torque transfer unit (e.g., the force applied by biasing element 344 against torque transfer units 334-1, 334-2 of FIG. 4). The relationship between torque and force is linear or approximately linear.

Because the torque remains constant or approximately constant, the rotation of the spindle (e.g., spindle 328 of FIG. 4) may be known for given force applied by the biasing element (e.g., biasing element 344 of FIG. 4). Or, in other words, the rotation of the spindle may be known for a given axial location of the biasing element.

A net torque, equaling the difference between the first torque (e.g., first torque 345 of FIG. 4) and the second torque (e.g., second torque 347 of FIG. 4), may be calculated. A target net torque may be the net torque required to maintain a desired rotational velocity, or a desired absolute orientation (e.g., orientation relative to north or relative to a gravitational direction). Because the first torque is known for a given force, the net torque may be controlled by changing the magnitude of the second torque using the torque generator (e.g., torque generator 348 of FIG. 4). By controlling the rotation of the net torque, the absolute orientation of the spindle and therefore the control unit (e.g., control unit 314 of FIG. 4) may be determined. Using the absolute orientation of the control unit, a rotary steerable system may be able to bias a drill bit in a desired direction. In this manner, the orientation of the control unit may be controlled using the rotation of one tubular body (e.g., tubular body 318 of FIG. 4).

Figure 6:
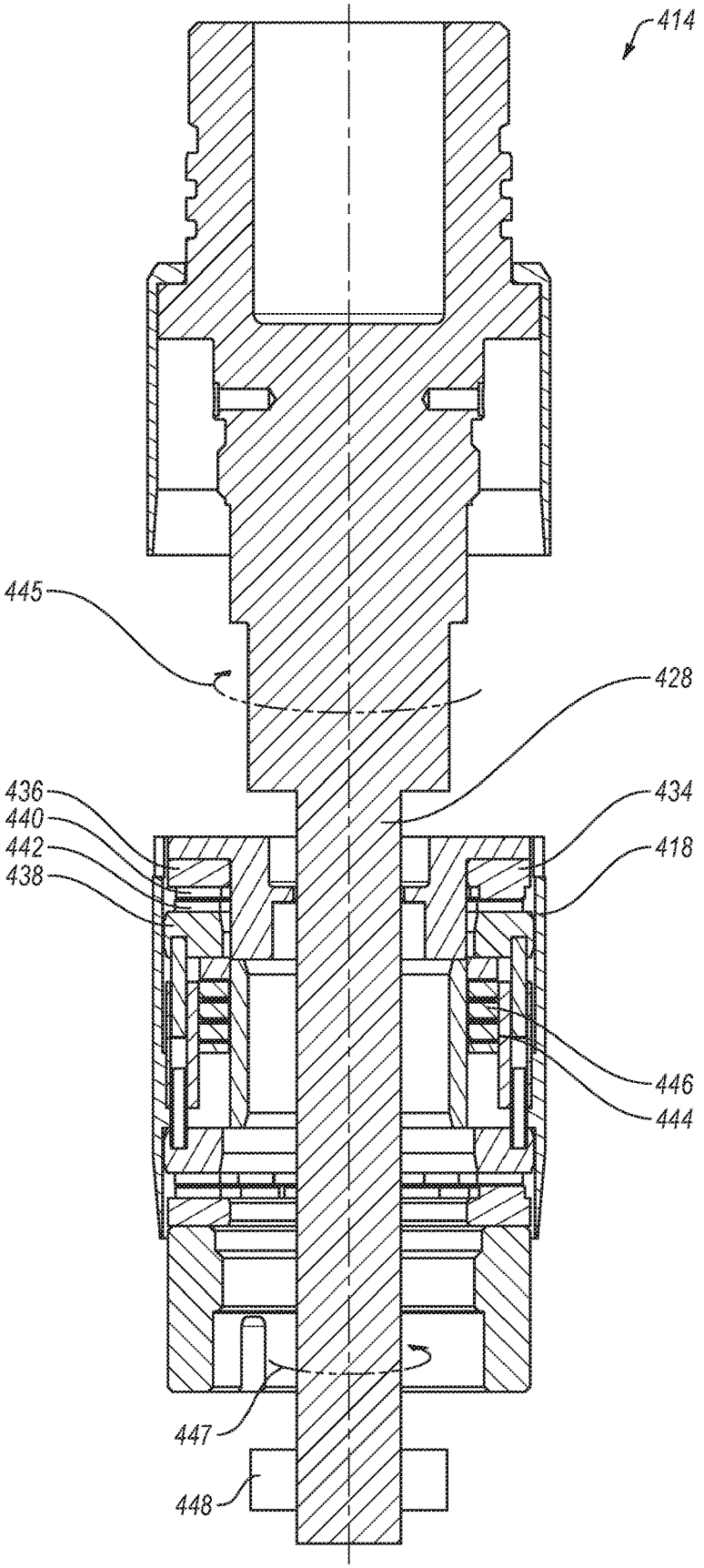
FIG. 6 is a longitudinal cross-sectional view of another control unit, according to at least one embodiment of the present disclosure.

FIG. 6 represents a control unit 414, according to at least one embodiment of the present disclosure. The control unit 414 may include at least some of the features and characteristics of any of the embodiments of control units described in relation to FIGS. 3, 4, and 5. In some embodiments, the tubular body 418 may be rotationally or rigidly connected to the drill bit (e.g., drill bit 106 of FIG. 1). Or, in other words, the tubular body 418 may rotate with the same rotational velocity as the drill bit. In other embodiments, the tubular body 418 may rotate with the same rotational velocity as any other portion of the BHA.

In some embodiments, the tubular body 418 may be connected to a torque transfer unit 434, having a first member 436 connected to the spindle 428, and a second member 438 connected to the tubular body 418. The first member 436 has a first bearing surface 440, and the second member 438 has a second bearing surface 442. The second member 438 abuts against the first member 436 such that the first bearing surface 440 is in contact with the second bearing surface 442. A biasing element 444 having a resilient member 446 may be biased against the second member 438, applying a force to the second member 438, which is transferred to the first member 436. A torque generator 448 may be connected to the spindle 428. In some embodiments, the torque generator 448 may be connected to the spindle 428 below (e.g., downhole) the torque transfer unit 434. In other embodiments, the torque generator 448 may be connected to the spindle 428 above (e.g., uphole) the torque transfer unit.

As the tubular body 418 rotates with the drill bit, the second member 438 will rotate relative to the first member 436. As discussed above in reference to FIG. 5, when the tubular body 418 rotates above the minimum rotational velocity, a first torque 445 will be transferred through the torque transfer unit 434 to the spindle 428. A second torque 447, opposite in direction to the first torque 445 may be applied to the spindle 428 from the torque generator 448. The net torque is the difference between the first torque 445 and the second torque 447.

A target net torque may be determined to keep the spindle 428, and therefore the control unit 414, rotating at a specific rotational velocity. Because, above the minimum rotational velocity, the first torque remains constant, or approximately constant (see FIG. 5), for a given force on the torque transfer unit 434, the target net torque may be maintained by adjusting the torque generator 448. Thus, the rotational velocity, and therefore the absolute orientation, of the control unit 414 may be maintained by adjusting the second torque 447 applied by the torque generator 448.

Figure 7:
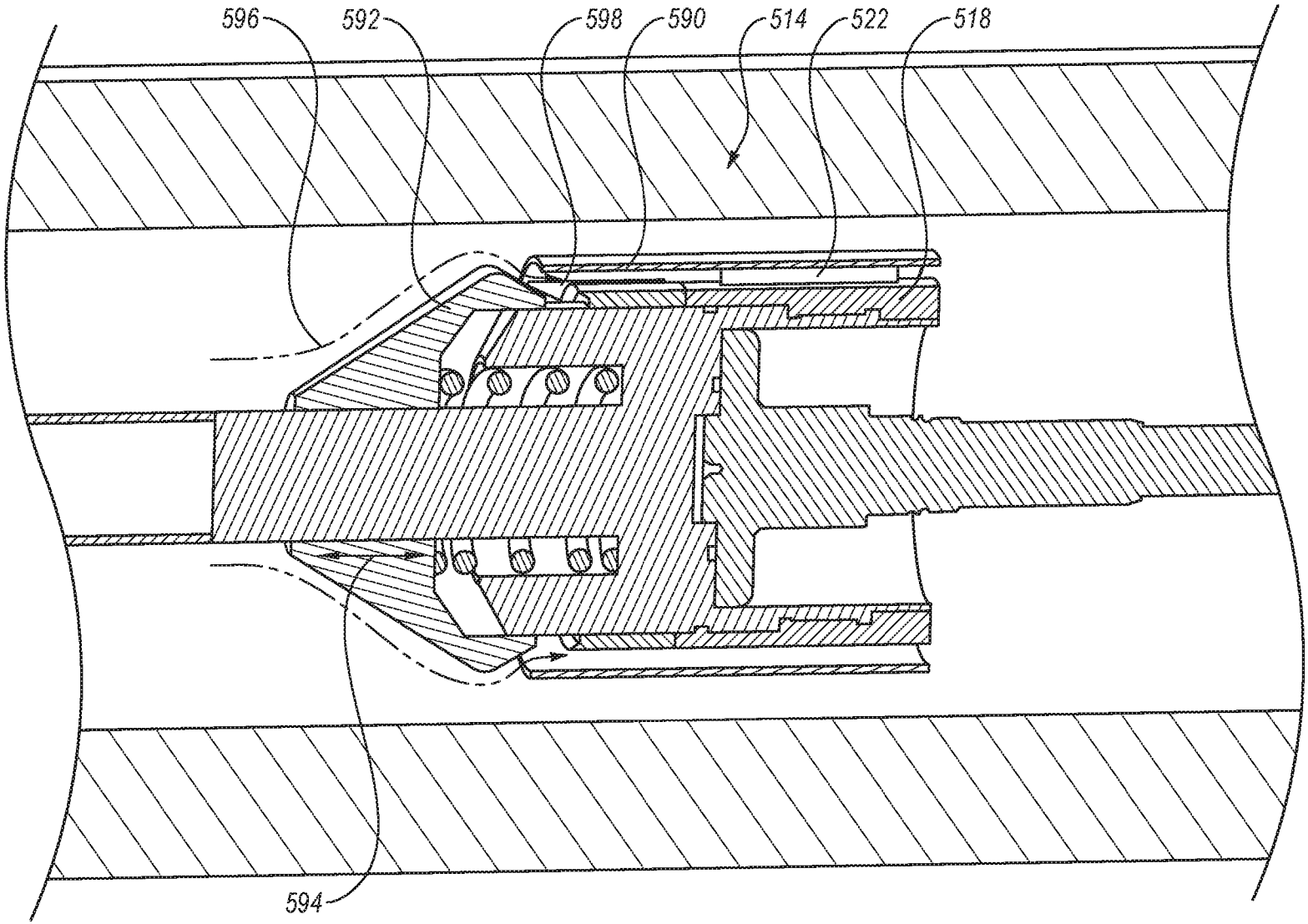
FIG. 7 is a longitudinal cross-section view of a movable nosepiece on a control unit, according to at least one embodiment of the present disclosure.

FIG. 7 illustrates an embodiment of a system for modulating a flow past a set of fins. For example, the system may include a nosepiece 592 positioned at an uphole end of the control unit 514. In some embodiments, the nosepiece 592 is movable in a longitudinal direction 594 relative to a sleeve 590 of the control unit 514. The sleeve 590 may house the fins 522 and/or tubular body 518 of the control unit 514 such that the tubular body 518 is rotated by a flow 596 of drilling fluid that passes through the sleeve 590 between the sleeve 590 and the tubular body 518.

In some embodiments, the nosepiece 592 is configured to selectively obscure an inlet 598 of the sleeve 590. In other words, the nosepiece 592 may move relative to the sleeve 590 in the longitudinal direction 594 being an open position and a closed position. In some embodiments, the nosepiece 592 is passively biased toward the open position. The nosepiece 592 may move longitudinally toward the closed position when the flow 596 applies a force to the nosepiece 592 and urges the nosepiece 592 toward the sleeve 590. In other embodiments, the longitudinal position of the nosepiece 592 is actively controlled.

For example, the nosepiece 592 may be moved by an electric motor or by hydraulic or pneumatic piston-and-cylinders in response to a detected flowrate past the tubular body 518 and/or in response to a detected torque applied to the tubular body 518.

In the open position, the nosepiece 592 may be located longitudinally away from the inlet 598 and may allow the flow 596 of drilling fluid to enter the sleeve 590, interacting with the fins 522 to move the tubular body 518. In the closed position, the nosepiece 592 may close or otherwise obscure the inlet 598 of the sleeve 590 such that the flow 596 into the sleeve 590 is lessened relative to the flow 596 in the open position. In some embodiments, the nosepiece 592 in a closed position prevents approximately all the flow 596 from entering the sleeve 590. For example, the nosepiece 592 may direct at least 85% of the flow 596 externally to the sleeve 590 in the closed position relative to the flow 596 in the open position. In other embodiments, the nosepiece may allow at least a portion of the flow 596 into the inlet 598 when in the closed position. For example, when in the closed position, the nosepiece 592 may allow at least 10%, at least 20%, or at least 30% of the flow 596 relative to the flow 596 in the open position.

A moveable nosepiece 592 may regulate the flow 596 past the fins 522. The nosepiece 592, therefore, may regulate a torque applied to the tubular body 518 by the flow 596 of drilling fluid. The force applied to the fins 522, and hence the torque applied to the tubular body 518, may be related to the flowrate, the fluid density, the viscosity, or other properties of the flow 596 of drilling fluid. For example, the flowrate may increase, which may undesirably increase the torque on the tubular body. A nosepiece 592 according to the present disclosure may move longitudinally toward the sleeve 590, reducing the flow 596 through the inlet 598, in response to the increase in flowrate to maintain a more constant torque on the tubular body 518. In other examples, the flowrate may remain the same while the drilling fluid density may increase, which may undesirably increase the torque on the tubular body. A nosepiece 592 according to the present disclosure may move longitudinally toward the sleeve 590, reducing the flow 596 through the inlet 598, in response to the increase in drilling fluid density to maintain a more constant torque on the tubular body 518. In each case, the increase in flowrate and the increase in drilling fluid density applies an increased force to the nosepiece 592, which may move the passively biased nosepiece 592 in the longitudinal direction 594 to adjust the flow 596 through the sleeve 590. In other examples, the nosepiece 592 may be actively moved in the longitudinal direction 594 by an electric motor or by hydraulic or pneumatic piston-and-cylinders.

Figure 8:
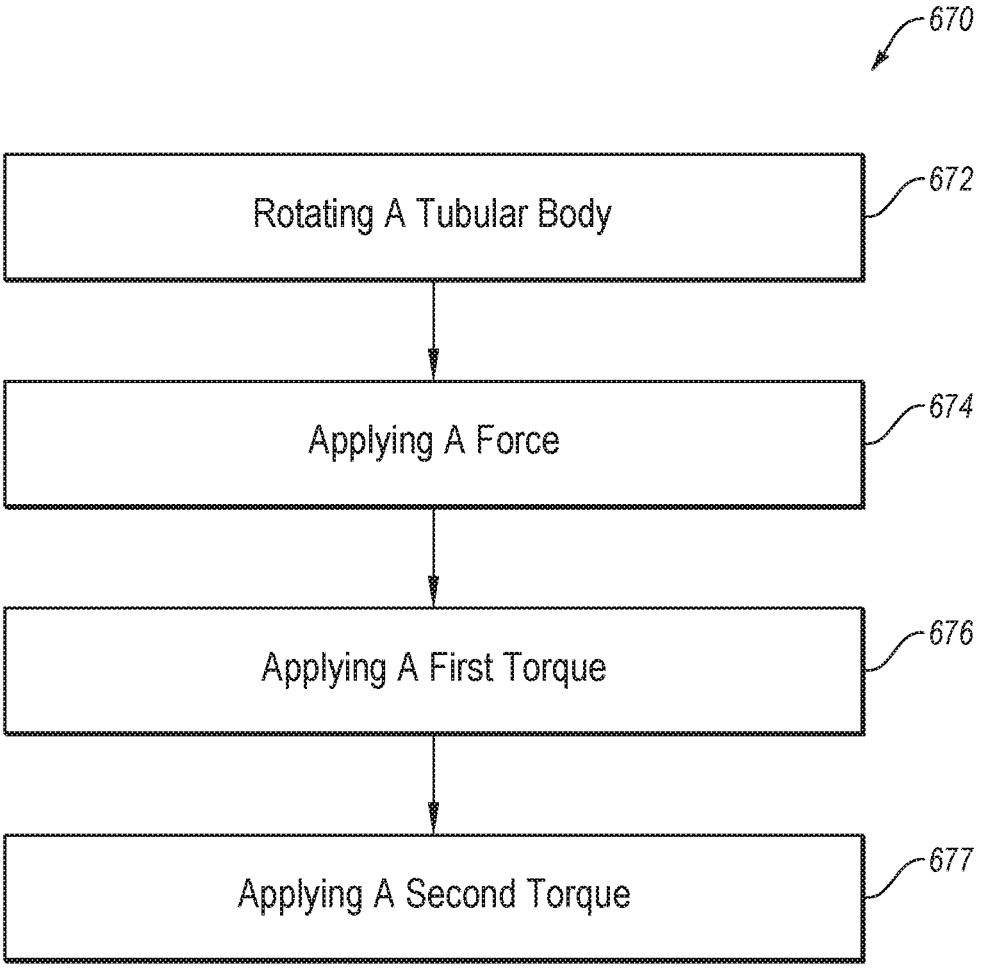
FIG. 8 is a method chart of a method of biasing a control unit, according to at least one embodiment of the present disclosure.

FIG. 8 is a method chart representing a method 670 for biasing a control unit. The method 670 includes rotating a tubular body at 672. In some embodiments, the tubular body may be rotated by passing drilling fluid across a plurality of fins. In other embodiments, the tubular body may be rotated with the rotation of a drill bit. The tubular body is rotated with a rotational velocity. In some embodiments, the tubular body may be rotated with a minimum rotational velocity. The tubular body may be connected to a first member of a torque transfer unit, with a second member of the torque transfer unit being connected to a spindle coaxial with the tubular body.

A force may be applied to the second member of the torque transfer unit with a biasing element at 674. In some embodiments, a first torque may be applied to the spindle through the torque transfer unit by the rotation of the tubular body at 676. The first torque may be applied by the sliding of the first member against the second member. In some embodiments, the first torque may be dependent upon the force applied on the second member. In some embodiments, the first torque may be independent of the rotational velocity greater than the minimum rotational velocity. A second torque may be applied to the spindle using a torque generator at 677.

Figure 9:
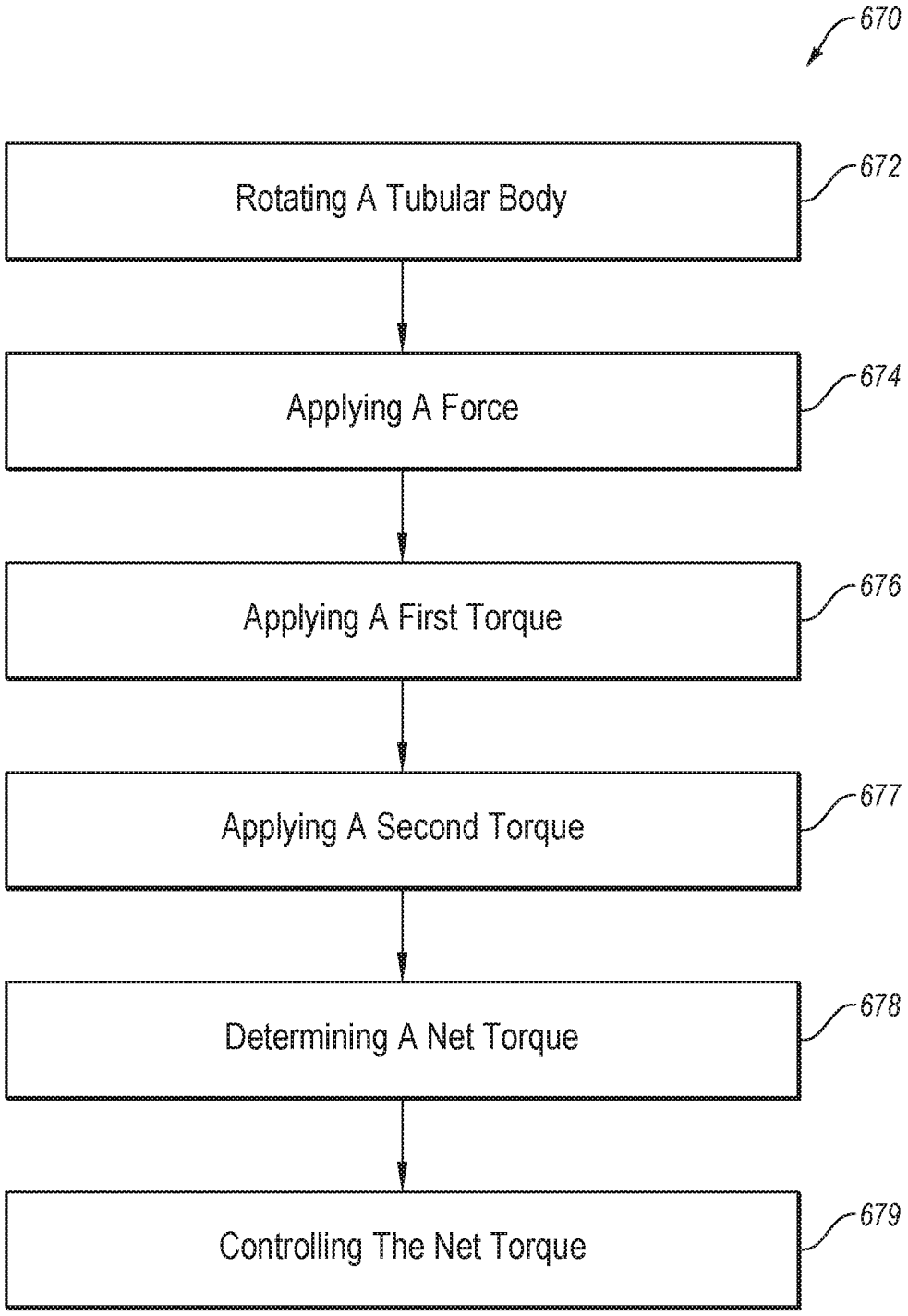
FIG. 9 is another method chart of the method of FIG. 8, according to at least one embodiment of the present disclosure.

FIG. 9 is a representation of the method 670 of FIG. 8, which further includes determining a net torque sufficient to maintain an absolute axial orientation at 678. The net torque is the difference between the first torque and the second torque. The net torque may be controlled by changing the second torque applied by the torque generator at 679.

Figure 10:
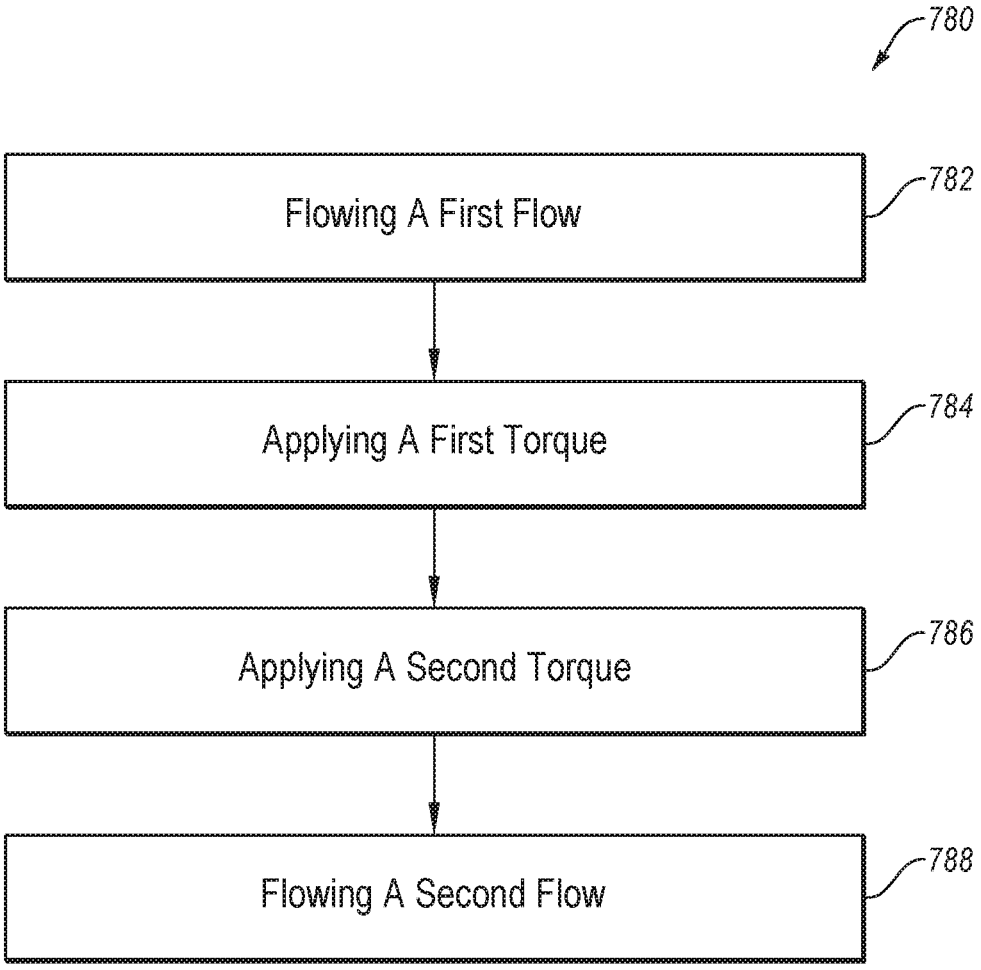
FIG. 10 is still another method chart of a method of biasing a control unit, according to at least one embodiment of the present disclosure.

FIG. 10 represents a method 780 for biasing a control unit. In some embodiments, a first flow of drilling fluid may be flowed through a control unit at 782. The first flow may have a fluid property with a first value. The fluid property may be at least one of fluid density, fluid composition, fluid velocity, or fluid viscosity, or any combination of the fluid properties.

Flowing the first flow may cause a tubular body to rotate with a first rotational velocity.

A first torque may be applied to a spindle through a torque transfer unit as a result of flowing the first flow at 784. A first member of the torque transfer unit may be rigidly connected to the spindle, and a second member of the torque transfer unit may be rigidly connected to the tubular body. Thus, when flowing the first flow rotates the tubular body, a first torque may be applied to the spindle. In some embodiments, two torque transfer units connected to a lip of the tubular body may be used to apply the first torque.

A second torque may be applied to the spindle using a torque generator at 786. The second torque may be applied in an opposite direction of the first torque. This will create a net torque, which is the difference between the first torque and the second torque. The net torque may be adjusted by changing or adjusting the second torque. In some embodiments, a second flow may be flowed through the control unit at 788. The second flow may have a different fluid property than the first flow. Flowing the second flow may cause the tubular body to rotate with a second rotational velocity, which is different from the first rotational velocity. The first torque may remain the same magnitude or have the same magnitude or approximately the same magnitude for the first rotational velocity and the second rotational velocity.

The embodiments of the control unit have been primarily described with reference to wellbore drilling operations; the control unit described herein may be used in applications other than the drilling of a wellbore. In other embodiments, a control unit according to the present disclosure may be used outside a wellbore or other downhole environment used for the exploration or production of natural resources. For instance, the control unit of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A control unit comprising:

a spindle;

a tubular body rotatable relative to the spindle, the tubular body including a plurality of fins;

a torque transfer unit having a first member attached to the spindle and a second member attached to the tubular body, the first member having a first bearing surface and the second member having a second bearing surface, the first bearing surface and the second bearing surface contacting each other with a friction force; and a torque generator configured to apply a torque to the spindle.

2. The control unit of claim 1, further comprising a second torque transfer unit adjacent to the torque transfer unit, the second torque transfer unit having a first bearing member attached to the spindle and a second bearing member attached to the tubular body.

3. The control unit of claim 1, the friction force being dependent upon a friction force between the first member and the second member.

4. The control unit of claim 1, the friction force being independent of a rotational velocity above a minimum rotational velocity.

5. The control unit of claim 1, further comprising a biasing element maintaining a position of the first member against the second member with a force.

6. The control unit of claim 5, the biasing element being selected from the group consisting of: a resilient member, a compliant member, a conical washer, a frustoconical washer, a Belleville spring, a coil spring, a leaf spring, a hydraulic piston and a pneumatic piston.

7. The control unit of claim 1, the tubular body being rotationally connected to a drill bit.

8. A method for biasing a control unit comprising:

rotating a tubular body with a rotational velocity, the tubular body connected to a first member of a torque transfer unit, a second member of the torque transfer unit being rigidly attached to a spindle coaxial with the tubular body;

applying a force against the second member using a biasing element;

applying a first torque on the spindle by sliding the first member against the second member; and applying a second torque on the spindle with a torque generator.

9. The method of claim 8, wherein applying the first torque is dependent on the force against the second member.

10. The method of claim 8, wherein rotating the tubular body includes rotating the tubular body relative to the spindle with a minimum rotational velocity.

11. The method of claim 10, wherein applying the first torque is independent of the rotational velocity when the rotational velocity is greater than the minimum rotational velocity.

12. The method of claim 8, further comprising:

determining a net torque on the spindle sufficient to maintain an absolute axial orientation, the net torque being a difference between the first torque and the second torque; and controlling the net torque by changing the second torque with the torque generator.

13. The method of claim 8, further comprising changing the first torque by changing the force applied by the biasing element.

* * * * *